US010500458B2

(12) United States Patent
Wolfe et al.

(10) Patent No.: US 10,500,458 B2
(45) **Date of Patent: *Dec. 10, 2019**

(54) HEATED LACROSSE STICK SHAFT

(71) Applicants: Samantha Kate Wolfe, Chappaqua, NY (US); Raeshon Lamont McNeil, Charlotte, NC (US); Jeremy Eric Losaw, Charlotte, NC (US)

(72) Inventors: Samantha Kate Wolfe, Chappaqua, NY (US); Raeshon Lamont McNeil, Charlotte, NC (US); Jeremy Eric Losaw, Charlotte, NC (US)

(73) Assignees: Samantha Kate Wolfe, Chappaqua, NY (US); Bruce E. Wolfe, Cappaqua, NY (US)

( * ) Notice: Subject to any disclaimer, the term of this patent is extended or adjusted under 35 U.S.C. 154(b) by 3 days.

This patent is subject to a terminal disclaimer.

(21) Appl. No.: 15/784,373

(22) Filed: Oct. 16, 2017

(65) Prior Publication Data

US 2018/0036610 A1 Feb. 8, 2018

Related U.S. Application Data

(63) Continuation of application No. 14/806,197, filed on Jul. 22, 2015, now Pat. No. 9,821,204.
(Continued)

(51) Int. Cl.
*A63B 59/20* (2015.01)
*A63B 71/06* (2006.01)
(Continued)

(52) U.S. Cl.
CPC ..... *A63B 59/20* (2015.10); *A63B 71/0619* (2013.01); *A63B 60/16* (2015.10);
(Continued)

(58) Field of Classification Search
CPC ..... A63B 59/20; A63B 71/0619; A63B 60/16; A63B 60/50; A63B 2102/14; A63B 2225/64; A63B 2071/0694; A63B 2207/02
See application file for complete search history.

(56) References Cited

U.S. PATENT DOCUMENTS 6,247,469 B1 * 6/2001 Guard ..... A63B 71/0045 126/263.01
2003/0218007 A1 * 11/2003 Cornell ..... A63B 53/14 219/541

(Continued)

FOREIGN PATENT DOCUMENTS

WO WO 2008136808 A1 * 11/2008 ..... A01K 27/003

*Primary Examiner* — Jeffrey S Vanderveen
(74) *Attorney, Agent, or Firm* — Duane Morris LLP

(57) ABSTRACT

A heating apparatus for use with an athletic device having a shaft and a plurality of hand holding locations associated with portions of the shaft. The heating apparatus comprises a removable self-contained module configured to be received within an athletic device shaft and to emit heat to at least two hand-holding locations of the athletic device shaft. The self-contained module comprises a plurality of heating elements configured to emit heat to the at least two hand-holding locations. The self-contained module further comprises a power source connected to supply electrical power to the plurality of heating elements. A user-operable control is coupled to the power source and configured to selectively power on and regulate the heat released from the heating elements.

16 Claims, 15 Drawing Sheets

Related U.S. Application Data

(60) Provisional application No. 61/999,283, filed on Jul. 23, 2014.

(51) Int. Cl.
*A63B 60/16* (2015.01)
*A63B 102/14* (2015.01)
*A63B 60/50* (2015.01)

(52) U.S. Cl.
CPC ..... *A63B 60/50* (2015.10); *A63B 2071/0694* (2013.01); *A63B 2102/14* (2015.10); *A63B 2207/02* (2013.01); *A63B 2225/64* (2013.01)

(56) References Cited

U.S. PATENT DOCUMENTS

2005/0103769 A1* 5/2005 Marquis ..... A01K 87/085
219/204
2014/0221137 A1* 8/2014 Krysiak ..... G09B 19/0038
473/570
2014/0235379 A1* 8/2014 Nurnberg ..... A63B 43/004
473/570

* cited by examiner

HEATED LACROSSE STICK SHAFT

CROSS-REFERENCE TO RELATED APPLICATIONS

This application claims priority to U.S. Provisional Application No. 61/999,283, filed Jul. 23, 2014 and U.S. patent application Ser. No. 14/806,197, filed on Jul. 22, 2015, the entirety of which are herein incorporated by reference.

TECHNICAL FIELD

The disclosure relates generally to a method and apparatus for heating a handle, and specifically to heating apparatuses and methods for use in lacrosse stick shafts or other sports equipment.

BACKGROUND

Many sports use ticks, bats or other hand-held implements that must be operated with speed, control and agility by the player. Specifically, lacrosse involves the use of a lacrosse stick. A lacrosse stick is typically comprised of a slender shaft or stick, the length of which is capped on one end by a soft end piece, and on the other end by a head. The shaft is the component that players grip when using the stick. The head is a frame, typically plastic and pear or gourd-shaped, with the broadest section furthest distal from the stick body, and holes around the sides where the nylon or leather is strung. This creates a "pocket" that can be used to catch, throw, and hold a ball. The broader section at the end of the head most distal from the stick is sometimes called the "shooting string," and the narrower segment between the distal end and the point at which the head couples to the stick, is sometimes called the "pocket." The soft plastic end piece attaches to the "butt end" of the shaft, and covers the metal edge at the end of the shaft to avoid inadvertent cutting or scraping against the metal edge at the end of the shaft.

A lacrosse stick is operated by one or two hands. Most of the elite lacrosse sticks today are made of extremely light weight but durable shafts, formed of aluminum or carbon fiber. However, in winter and in colder climates, problems arise when players attempt to grip the lacrosse shaft and manipulate a lacrosse stick. In cold temperatures, players' hands become colder and their joints become less agile, and the cold aluminum or carbon fiber of the lacrosse shaft is uncomfortable and distracting for a player. Additionally, the lacrosse shaft itself often conducts heat away from a player's hands, exacerbating the coldness.

A suggested resolution to this is to wear gloves to protect a player's hands from the cold. For example, women's lacrosse players may wear thin gloves and men's lacrosse players may wear thicker padded gloves to address the cold temperatures, though either players may attempt to use either thin or thick gloves. However, while wearing common lacrosse gloves, and especially where such gloves are thick, the gloves also inhibit movement and reduce grip by the hands and fingers, and consequently limit dexterity. Further, even thin gloves may limit dexterity, and even thick gloves may not offer adequate protection against cold temperatures. Therefore, for both men's and women's lacrosse, gloves are not a solution to the problems created by cold weather for lacrosse players.

There remains a need for a lacrosse shaft that can be gripped and manipulated in cold weather, without the need for gloves, and that minimizes or alleviates the discomfort and distraction of the cold.

SUMMARY

In some embodiments, an apparatus for use with an athletic device having a shaft and a plurality of hand-holding locations associated with portions of the shaft includes a removable self-contained module. The removable self-contained module is configured to be received within an athletic device shaft and to emit heat to at least two hand-holding locations of the athletic device shaft. The self-contained module comprises: a plurality of heating elements configured to emit heat to the at least two hand-holding locations; a power source configured to supply electrical power to the plurality of heating elements; and, a user operable control. Wherein, the user-operable control is coupled to the power source, and configured to selectively power on and regulate heat released from the heating elements.

In some embodiments, a heating sleeve for use with an athletic device shaft includes a heating apparatus configured to be placed on an outer peripheral portion of athletic device shaft end. The heating apparatus comprises: a plurality of heating elements configured to emit heat to an outer peripheral portion of the heating sleeve; a power source connected to supply electrical power to the plurality of heating elements; and, a user-operable control, wherein the user-operable control is coupled to the power source, and selectively regulates heat emitted from the plurality of heating elements.

In some embodiments, a kinetic heating apparatus for use with an athletic device comprises a kinetic energy charger and at least one heating element. The kinetic energy charger is coupled to a rechargeable power source configured to be disposed within an athletic device shaft and configured to harvest kinetic energy of the athletic device shaft movement to recharge the rechargeable power source. The at least one heating element is operably coupled to the rechargeable power source and configured to emit heat to at least one hand-holding location along the athletic device shaft.

BRIEF DESCRIPTION OF THE DRAWINGS will be or become apparent to one with skill in the art by reference to the following detailed description when considered in connection with the accompanying exemplary non-limiting embodiments.

FIG. 1*a* illustrates an exploded, partial, side perspective view of a lacrosse stick heating apparatus shaft and end piece in accordance with some embodiments.

FIG. 1*b* illustrates an enlarged side view of the lacrosse stick heating apparatus end piece and power source of FIG. 1*a*.

FIG. 2 illustrates a top view of a lacrosse stick resistive heating pad in accordance with some embodiments.

FIG. 3*a* illustrates an enlarged, partial, perspective view of a lacrosse stick shaft containing a resistive strip heating element in accordance with some embodiments.

FIG. 3*b* illustrates a side perspective view of a lacrosse stick end piece for connecting with the shaft containing a resistive strip heating element of FIG. 3*a*.

FIG. 4 illustrates a side exploded view of a lacrosse stick heating apparatus using a heated coil design as the heating element, in accordance with some embodiments.

FIG. 5*a* illustrates a side perspective view of a lacrosse stick heating apparatus in accordance with some embodiments.

FIG. 5*b* illustrates an end perspective view of the lacrosse stick heating apparatus of FIG. 5*a* applied to a lacrosse stick shaft and an accompanying end piece.

FIG. 5*c* illustrates a side view of the lacrosse stick end piece of FIG. 5*b*.

FIG. 6*a* illustrates a side perspective view of a lacrosse stick heating apparatus in accordance with some embodiments.

FIG. 6*b* illustrates a perspective view of the lacrosse stick heating apparatus of FIG. 6*a* applied to a lacrosse stick shaft.

Figure 12A:
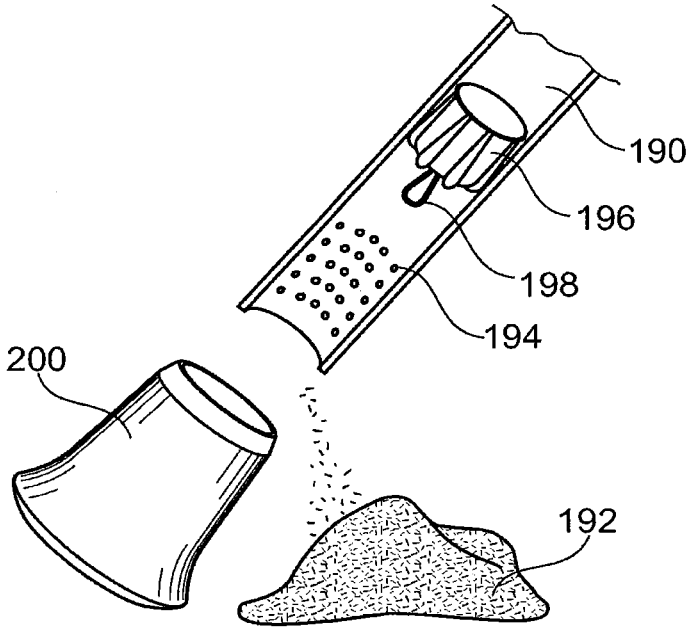

FIG. 12*a* illustrates a cut-away side view of a lacrosse stick shaft configured to heat the shaft using exothermic oxidation in accordance with some embodiments.

Figure 12B:
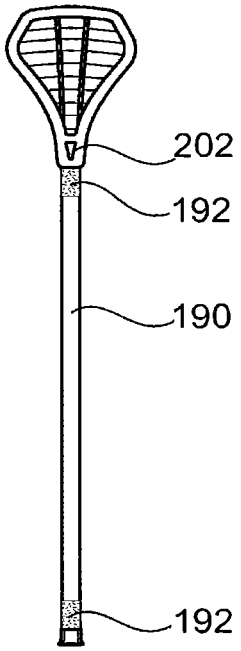

FIG. 12*b* illustrates a side view of the lacrosse stick shaft of FIG. 12*a*.

Figure 13:
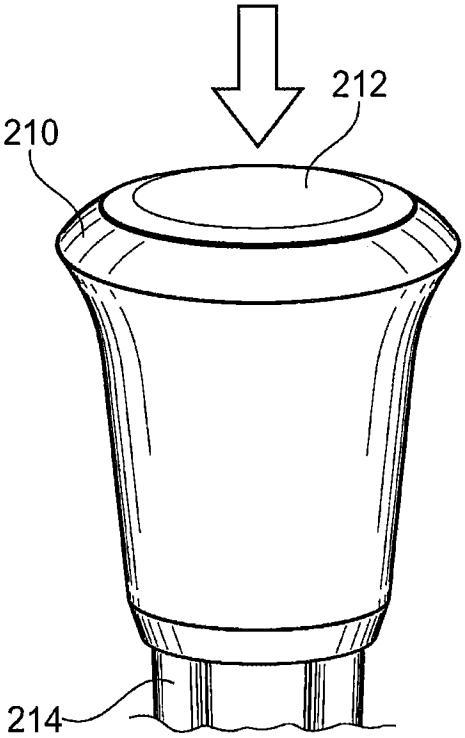

FIG. 13 illustrates a side view of a lacrosse stick end piece with a user-operable control in accordance with some embodiments.

Figure 14:
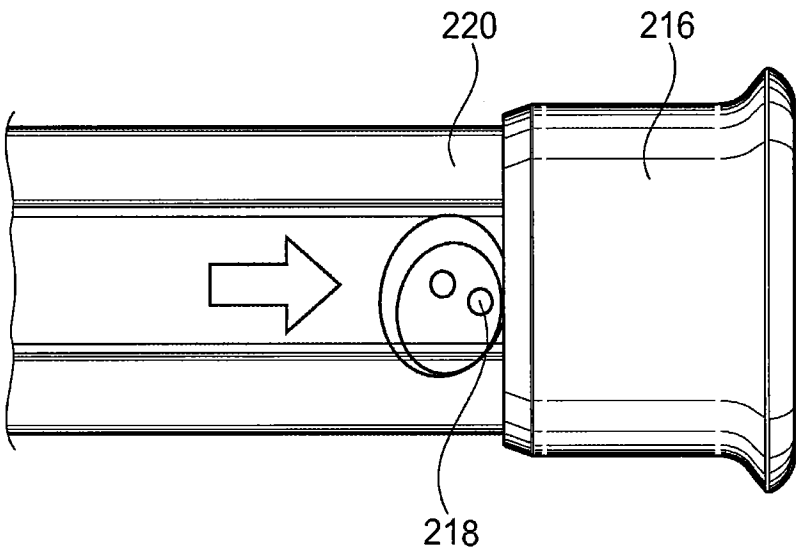

FIG. 14 illustrates a side view of a lacrosse stick end piece and a partial view of a lacrosse stick shaft with a user-operable control in accordance with some embodiments.

DETAILED DESCRIPTION

With reference to the figures, where like elements have been given like numerical designations to facilitate an understanding of the drawings, various embodiments of an apparatus for a wardrobe management tool are described. The figures are not drawn to scale.

This description of the exemplary embodiments is intended to be read in connection with the accompanying drawings, which are to be considered part of the entire written description. The use of the singular includes the plural unless specifically stated otherwise. The use of "or" means "and/or" unless stated otherwise. Furthermore, the use of the term "including," as well as other forms such as "includes" and "included," is not limiting. In addition, terms such as "element" or "component" encompass both elements and components comprising one unit, and elements and components that comprise more than one subunit, unless specifically stated otherwise. Additionally, the section headings used herein are for organizational purposes only, and are not to be construed as limiting the subject matter described.

The following description is provided as an enabling teaching of a representative set of examples. Many changes can be made to the embodiments described herein while still obtaining beneficial results. Some of the desired benefits discussed below can be obtained by selecting some of the features discussed herein without utilizing other features. Accordingly, many modifications and adaptations, as well as subsets of the features described herein are possible and can even be desirable in certain circumstances. Thus, the following description is provided as illustrative and is not limiting.

This description of illustrative embodiments is intended to be read in connection with the accompanying drawings, which are to be considered part of the entire written description. The drawing figures are not necessarily to scale and certain features of the invention can be shown exaggerated in scale or in somewhat schematic form in the interest of clarity and conciseness. In the description of embodiments disclosed herein, any reference to direction or orientation is merely intended for convenience of description and is not intended in any way to limit the scope of the present disclosure. Relative terms such as "horizontal," "vertical," "up," "down," "top," and "bottom" as well as derivatives thereof (e.g., "horizontally," "downwardly," "upwardly," etc.) should be construed to refer to the orientation as then described or as shown in the drawing figure under discussion. These relative terms are for convenience of description and normally are not intended to require a particular orientation. Terms including "inwardly" versus "outwardly," "longitudinal" versus "lateral," and the like are to be interpreted relative to one another or relative to an axis of elongation, or an axis or center of rotation, as appropriate. Terms concerning attachments, coupling, and the like, such as "connected" "interconnected," "attached" and "affixed," refer to a relationship wherein structures are secured or attached to one another either directly or indirectly through intervening structures, as well as both movable or rigid attachments or relationships, unless expressly described otherwise. The terms "operatively connected" or "operatively coupled" are such an attachment, coupling or connection that allows the pertinent structures to operate as intended by virtue of that relationship. The term "adjacent" as used herein to describe the relationship between structures/components includes both direct contact between the respective structures/components referenced and the presence of other intervening structures/components between respective structures/components.

As used herein, use of a singular article such as "a," "an" and "the" is not intended to exclude pluralities of the article's object unless the context clearly and unambiguously dictates otherwise.

The present disclosure generally relates to a lacrosse stick shaft heating method and apparatus providing for at least two hand-holding locations heated by at least one heating element. The heating element may be electrical, chemical or phase-change, and is activated and regulated by a user-operable control.

The lacrosse stick shaft heating method and apparatus allows lacrosse players to more comfortably grip a lacrosse stick in cold weather, eliminating or reducing the need for thick or thin gloves while maintaining dexterity and comfort. This will increase usability of the lacrosse stick by relieving discomfort normally felt by a lacrosse player gripping a lacrosse stick in cold weather, as well as warming the lacrosse player's joints and thereby supporting more optimal dexterity.

FIG. 1 illustrate a side perspective view of a lacrosse stick heating apparatus (10) for use with a shaft (12) of a lacrosse stick, the heating apparatus (10) having an end piece (14) in accordance with one embodiment.

The heating apparatus (10) of FIG. 1 comprises an end piece (14) configured for mounting on or in the shaft (12) of a lacrosse stick. The end piece (14) of the illustrated embodiment has a user-operable control (16) that connects to a power source (18) which may be preferably be held by an enclosure (20) coupled to the end piece (14) or shaft (12). The enclosure (20) may include a tab (24) to facilitate removal of the battery for replacement. The end piece (14) may be configured to be either coupled permanently to the shaft (12) or is configured to be removable from the shaft (12). The format, including the shape, weight, size and location, of the heating apparatus (10) in this and other embodiments may be configured to conform to lacrosse stick regulations promulgated by lacrosse governing bodies, including but not limited to US Lacrosse, the Federation of International Lacrosse (FIL), the National Collegiate Athletic Association (NCAA), or the National Federation of State High School Associations (NFHS).

In a preferred embodiment, the power source (18) may be electrochemical, and more specifically may be one or more disposable or rechargeable batteries, including but not limited to those based on zinc-manganese dioxide (Zn/Mn0 2 or standard alkaline), nickel cadmium (NiCd), nickel metal-hydride (NiMH), lithium ion (Li-ion), lithium-thionyl chloride (Li-SOCb), or lithium-sulfur dioxide (Li—S0 2) technology. The power source (18) may be purchased or designed according to common standard sizes promulgated by organizations such as the International Electrotechnical Commission (IEC), International Organization for Standardization (ISO) or American National Standards Institute (ANSI). Alternatively, the power source (18) may be of a non-standard or proprietary size and design. The power source (18) of certain embodiments is of a size and shape to fit within the shaft (12). The power source (18) may be either permanently coupled with the heating apparatus (10), or removable and replaceable. In certain examples, the power source (18) may be one or more size AA batteries. The power source (18) and/or the user-operated control (16) may also be coupled with a printed circuit board (PCB) or other circuitry to enable more efficient power control or appropriate interface between the power source (18) and the user-operable control (16).

The power source (18) is connected to one or more heating elements by wires (22) or any adequate means to transfer power from the power source (18) to the heating element, located in or on the shaft (12). The user-operable control (16) is coupled to the power source (18) and is operable by a user to activate the power source (18) by engaging the user-operable control (16), thereby regulating power delivered to the heating element inside the shaft (12).

The user-operable control (16) may be a button, flexible metal disc, toggle, switch, dial, digital selector, potentiometer, or any other combination of these or other means by which a user may directly or indirectly regulate administration of power from the power source (18) to the heating element. A user may engage the user-operable control (16) to activate the heating element, to deactivate the heating element, or to more finely regulate the amount of heat being released from the heating element. The user-operable control (16) may be a single piece or comprise multiple pieces, such as an "on/off" switch, an "on/off" switch plus a temperature dial, a single dial with "off/low/medium/high" settings, or any other configuration that functions to regulate the amount of heat being released from the heating element. Additionally, the user-operable control (16) may be located at another location, including on the shaft (12), near a hand-holding location, or at another location convenient to engage its operation while the lacrosse stick is in use.

As shown in FIG. 1, a preferred embodiment is configured to allow the enclosure (20) and/or power source (18) to fit inside the shaft (12) when the end piece (14) is affixed to the end of the shaft (12). However, this disclosure is not meant to be limiting and the enclosure (20) and/or power source (18) may also be located substantially or entirely inside the end piece (14).

Additionally, in embodiments that contain a rechargeable power source (18), the end piece (14) may also include a power input connector (28) configured to connect to an external power supply, and recharge the power source (18). This power input connector (28) may be selected from standardized connector types including, but not limited to, universal system bus (USB), micro-USB, and other connectors from specification and standards-setting organizations such as the IEC, ISO and ANSI. Alternatively, the power input connector (28) may be a proprietary connector configured to supply and recharge power to the power source (18) from any external power supply. As a further alternative, the power input connector (28) may be located elsewhere on the lacrosse stick, including on the shaft (12) or head. The connector may optionally have a cover (26) to protect the power input connector (28) from the environment during use of the lacrosse stick. The cover (26) of the illustrated embodiment includes a sliding cover element mounted for movement in a channel in the end piece (14) between a position covering the power input connector (28) and a position exposing the power input connector (28). Other configurations for the cover may be provided, such as a pivoting cover, hinged cover, or flexible flap cover.

In this embodiment, one or more heating elements are positioned within the lacrosse stick shaft (12) at areas proximate to the hand-holding locations on the lacrosse stick shaft (12). When the user-operable control (16) is activated, power is provided to the heating apparatus, which then generates heat using the heating element, thereby supplying heat to one or more hand-holding locations. The use of singular is not limiting. A single heating element may contain multiple heat-generating portions to heat multiple hand-hold areas. Similarly, a single heating element with a single heat-generating portion may heat multiple hand-hold areas. By selectively regulating the power to the heating element in this and in other embodiments, a user-operable control (16) may obtain temperatures at the hand-holding locations of between 55° F. and 130°, and preferably between 55° F. to 90° F. Other temperature ranges are possible as well.

Figure 1A:
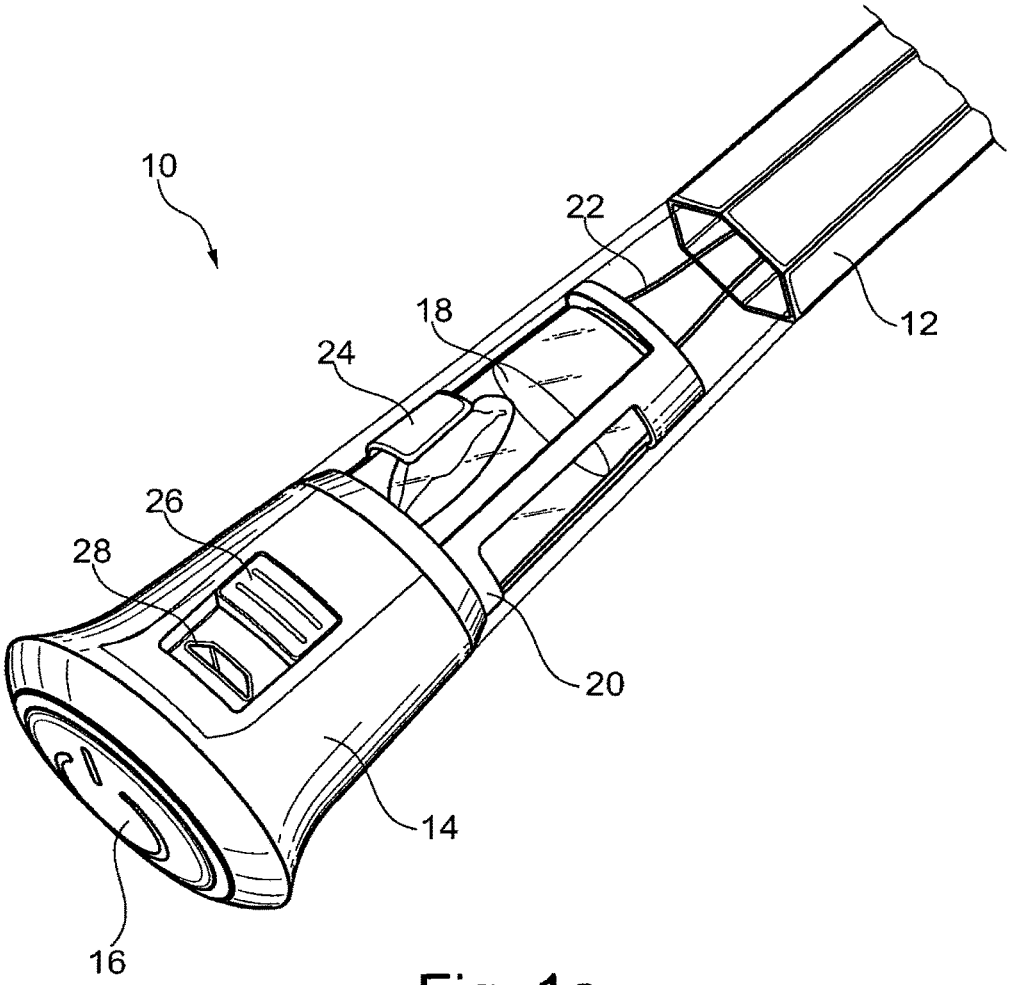
Figure 1B:
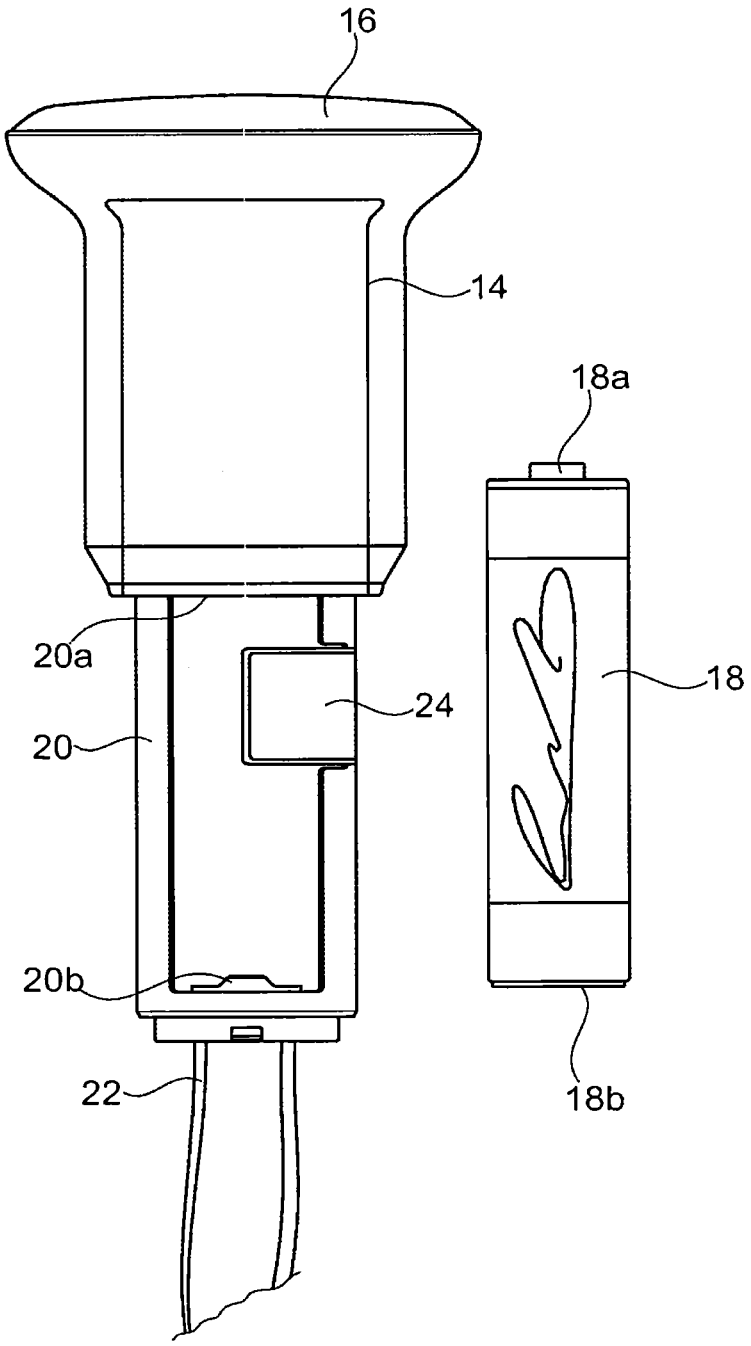

FIG. 1*b* illustrates a side view of the lacrosse stick heating apparatus end piece (14) and power source (18) of FIG. 1*a*.

The end piece (14) is configured with a user-operable control (16) that connects to a power source (18) which may be preferably be held by an enclosure (20) coupled to the end piece (14). In FIG. 1*b*, an example of the power source (18) is shown removed from the enclosure (20). In this example, the power source (18) may be a standardized battery with standardized cathode and anode connectors (18*a*, 18*b*) that mate to accompanying connectors (20*a*, 20*b*) within the enclosure (20). In certain examples, the battery is an AA cell battery, AAA cell battery, lithium battery including a rechargeable lithium battery, a 14500 size battery, or any of the power source options discussed herein.

Figure 2:
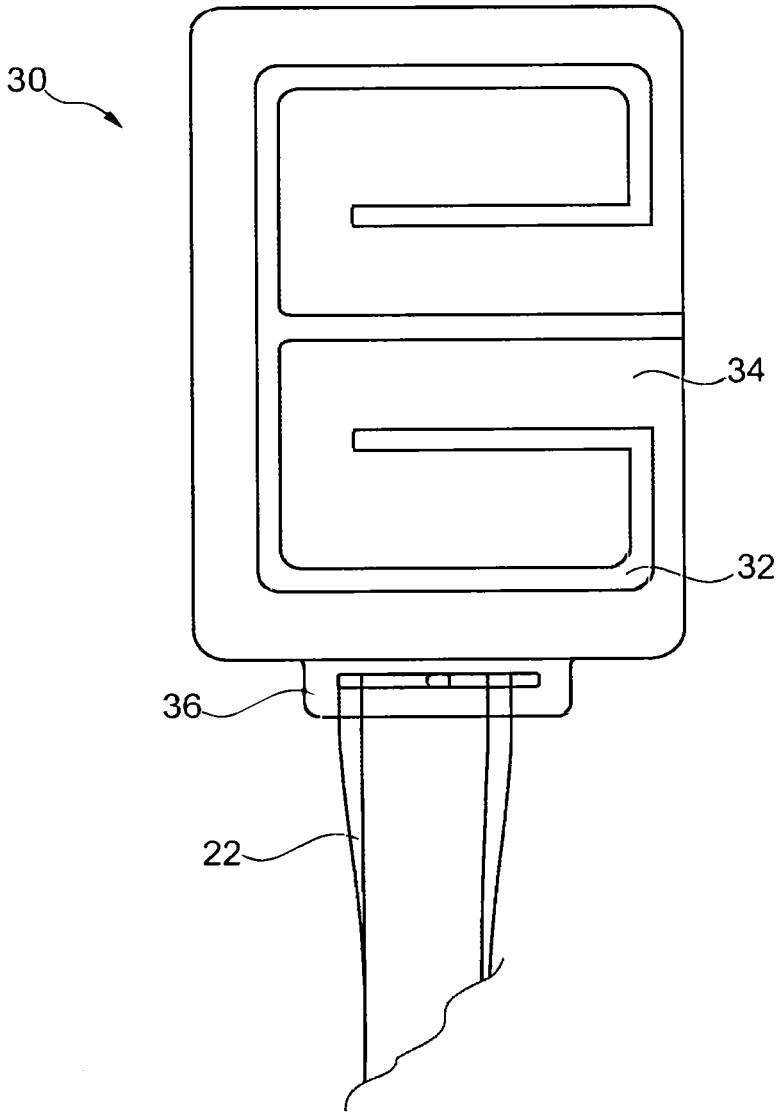

FIG. 2 illustrates a top view of a resistive heating pad (30) in accordance with an embodiment.

The resistive heating pad (30) is comprised of a resistive heating element (32) arranged within or on the resistive heating pad (30) in order to distribute heat relatively uniformly. The resistive heating element (32) may be comprised of metal wire or any other material configured to safely emit heat by the passage of electric current. The resistive heating element (32) may be embedded upon or coupled with pad material (34), preferably comprised of a thermal insulating material including silicon, neoprene, rubber, or a similarly heat-resistant material. The resistive heating pad (30) is configured to fit within a lacrosse stick shaft. For example, the heating pad (30) may be shaped to fit an interior space of the lacrosse stick such as by being generally cylindrical, hexagonal or of another shape, or by being formed of a flexible sheet that may be deformed or rolled for positioning within the lacrosse stick. The heat generated by the resistive heating pad (30) when activated then passes from the interior of the lacrosse stick through the material of lacrosse stick shaft to the exterior surface of the stick to heat hand-holding locations on the outer surface of the lacrosse stick.

The resistive heating pad (30) receives power from a power source by two or more wires (22) or by conductors or any adequate means, including wireless means. The wires (22) may couple directly with the resistive heating pad (30) via a power input connector (36).

Figure 3A:
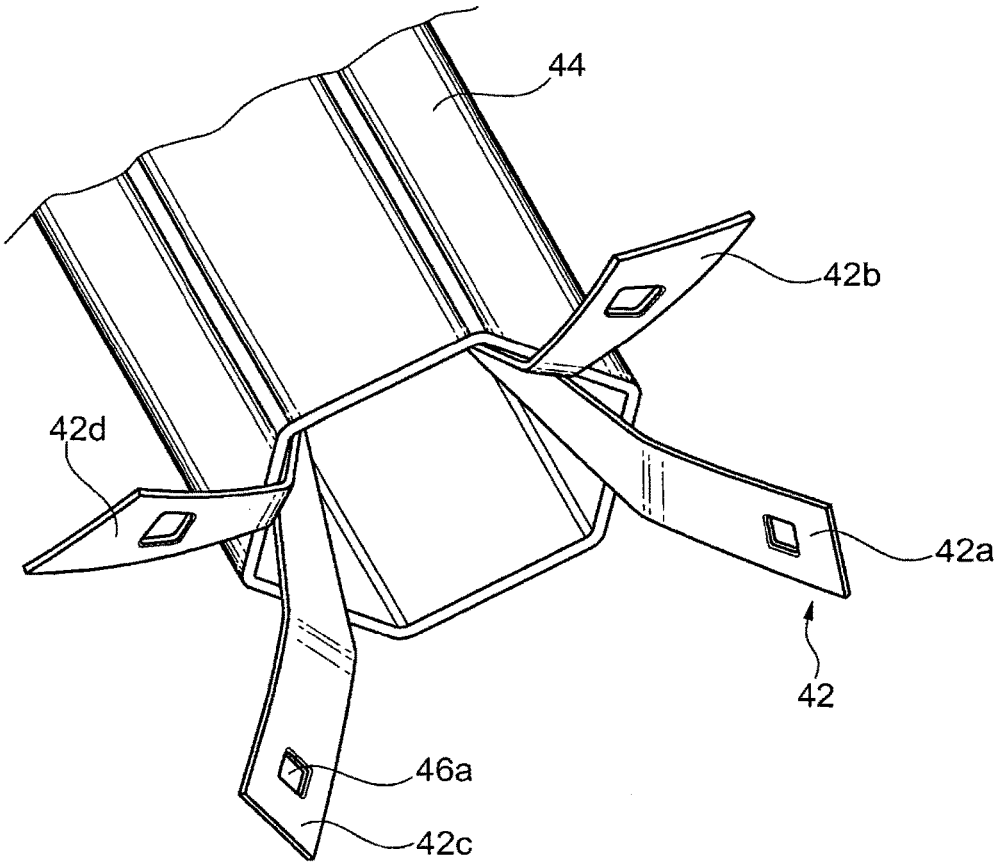
Figure 3B:
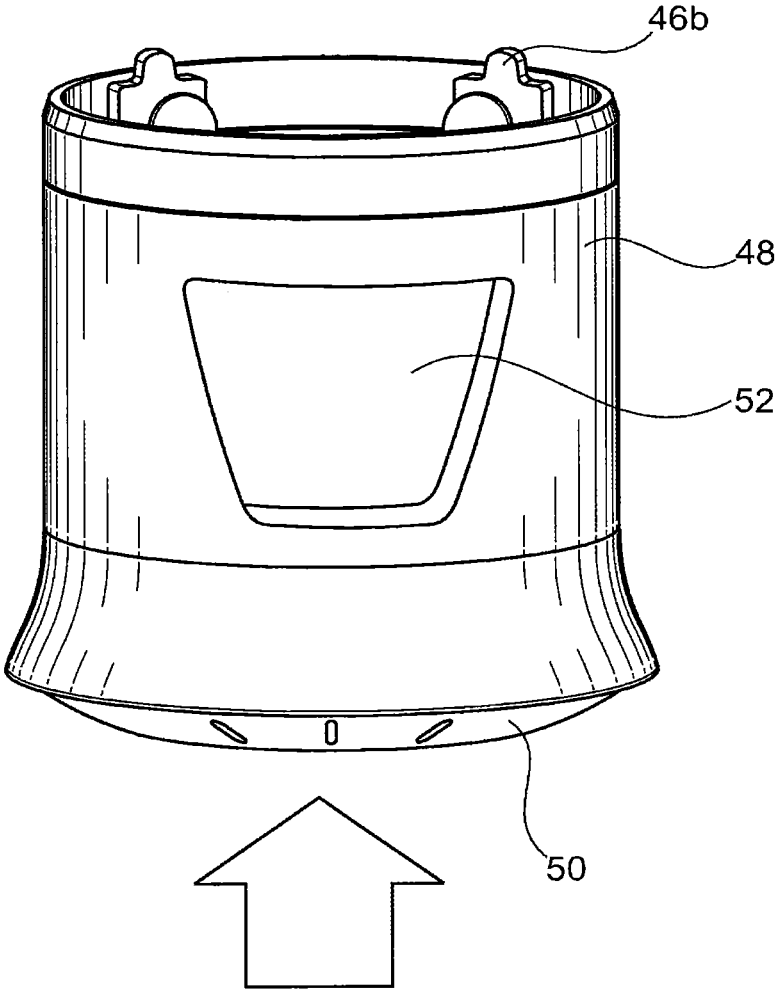

FIGS. 3*a* and 3*b* illustrate a lacrosse stick shaft (44) containing a resistive strip or wiring heating element in accordance with another embodiment, and a side perspective view of an end piece (48) configured for connecting with the shaft (44).

In this embodiment, an arrangement of four conductive strips (42) is provided within the lacrosse stick shaft (44). The four conductive strips (42*a*, 42*b*, 42*c*, 42*d*) may have elongated conductive elements and insulating coverings over at least portions of the conductive elements. The conductive strips (42) may be arranged to run generally in parallel along at least a portion of the interior such as by being disposed against an internal perimeter surface of the shaft (44). Conductive strips (42) are shown to provide power to two separate heating elements within the shaft (44). The number of strips in FIG. 3*a* is not limiting, and the number of strips or wires may vary as desired, for example to provide controllable heating to one or more locations within or on the shaft (44). The conductive strips (42) may be affixed to the inside of the lacrosse stick shaft (44) using mounting methods known in the art, including heat resistant adhesive, retention tabs, clips, rivets, screws or other mountings. Connector sites (46*a*) may be provided for connecting the conductive strips (42) to connectors in the end piece (48). Whatever connecting method is chosen, the connection optimally allows a substantial amount of power to be supplied to the heating element(s) so that heat passes through the walls of the lacrosse stick shaft (44) to hand-holding locations.

The conductive strip (42) connector sites (46*a*) couple to tab connectors (46*b*) mounted inside an end piece (48) that is configured for mounting at the butt end of the lacrosse stick. In the illustrated embodiment, the tab connectors (46*b*) include four connector elements mounted in the end piece (48) and extending toward the lacrosse stick. Each of the tab connectors (46*b*) may be in the form of a strip having a tip projecting beyond the end of the strip from the center of the strip. The tabs may connect to the connector sites (46*a*). The end piece (48) may contain a power source which couples to both the conductive strips (42) and a user-operable control (50). The user-operable control (50) may be comprised of any of the configurations previously discussed, such as a button, flexible metal disc, toggle, switch, dial, digital selector, pressure-sensitive activation device, knob, potentiometer, or any other combination of these or other means by which a user may directly or indirectly regulate administration of power from a power source to the heating element(s) connected to the conductive strips (42). The user-operable control (50) of the illustrated embodiment is operated by pressing an end of the end piece (48), as indicated. A recess (52) may be formed in the side of the end piece (48), which may provide a grip to remove the end piece (48) in embodiments with a removable end piece (48), a location for an indicator, or other features.

Figure 4:
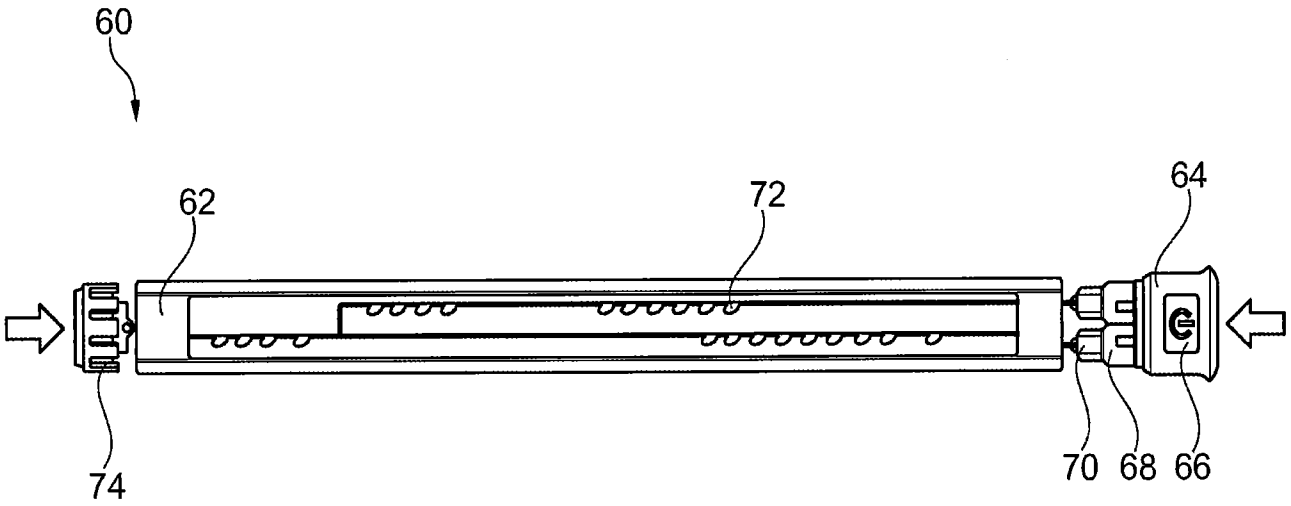

FIG. 4 illustrates a side exploded view of a lacrosse stick heating apparatus using a heating coil design as the heating element, in accordance with another embodiment.

A heating apparatus (60) of FIG. 4 is a self-contained module (62) that may be inserted into a lacrosse stick shaft. In this embodiment, the heating apparatus (60) is comprised of an end piece (64) comprising a user-operable control (66); a power source (68) contained in an enclosure (70); a heating element (72); and a module cap (74). The power source (68) is coupled to the user-operable control (66) and to the heating element (72), which extends from the edge of the power source (68) to the module cap (74). In this embodiment, when a user operates the user-operable control (66), power is selectively supplied to the heating element (72). When power is supplied to the heating element (72), it radiates heat to the walls of the module (62). The heat then transfers to the inside surface of the lacrosse stick shaft. The heating element (72) is positioned within the lacrosse stick shaft at the hand-holding locations so that the heat is conducted through the walls of the lacrosse stick shaft to the hand-holding locations on the outside of the lacrosse stick.

In a preferred embodiment, the heating element (72) of FIG. 4 includes a coiled wire resistive heating element. However, the heating element (72) may be comprised of metal wire or any other material configured to safely emit heat. The user-operable control (66) may be comprised of any of the configurations previously discussed, such as a button, flexible metal disc, toggle, switch, dial, digital selector, potentiometer, or any other combination of these or other means by which a user may directly or indirectly regulate administration of power from the power source (68) to the heating element (72). In the illustrated embodiment, the user-operable control (66) includes a push button on the side of the end piece (64). An indicator indicating power control may be marked on the push button.

Figures 5A, 5B, 5C:
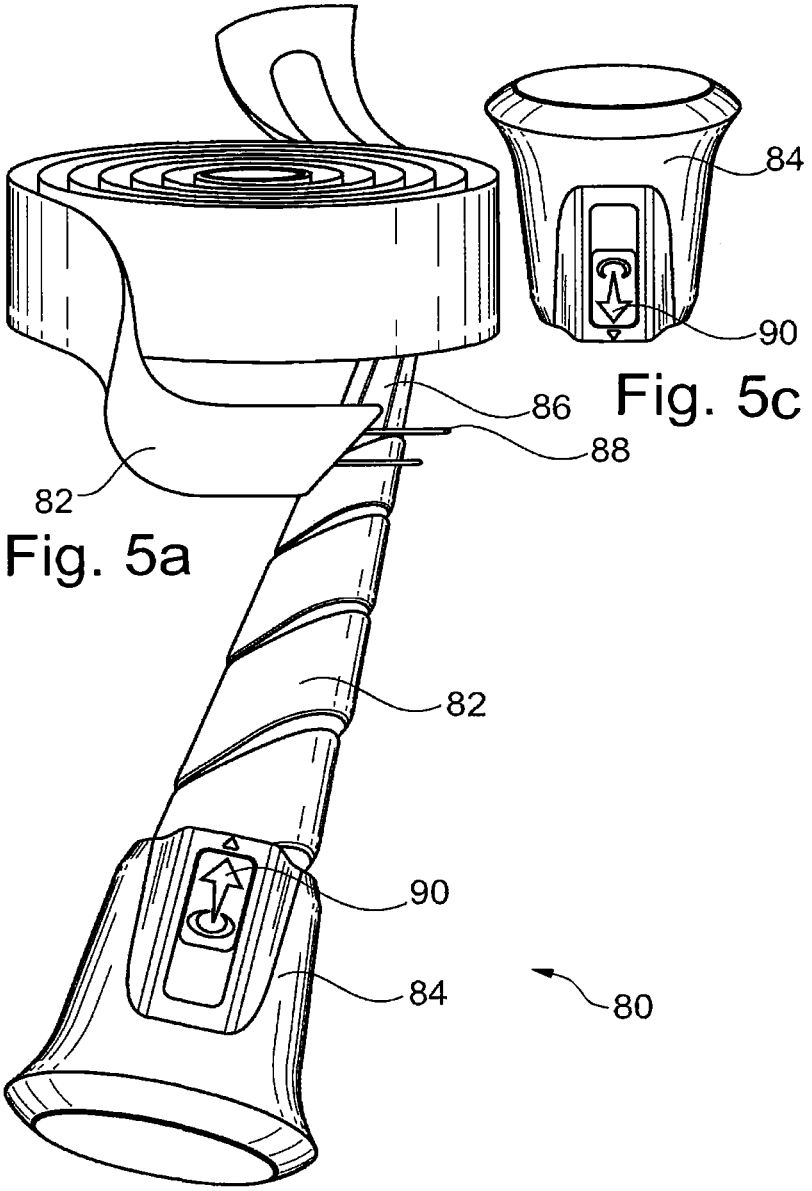

FIGS. 5*a*, 5*b* and 5*c* illustrate views of a lacrosse stick heating apparatus (80) in accordance with another embodiment, of the heating element (82) applied to a lacrosse stick shaft (86), and of an accompanying end piece (84).

In this embodiment, the heating element (82) is applied to the external surface of the lacrosse stick shaft (86) rather than being mounted inside the stick. Preferably in this embodiment, the heating element (82) may be a resistive thermal tape or other flexible wrap that can be custom fit and positioned on the external surface of a lacrosse stick shaft (86).

For example, the heating element (82) may contain one or more conductive wires (88) connected to resistive heating elements within the tape that are operable to generate and radiate heat when electricity is applied. In this example, the conductive wires (88) at the terminal end of the heating element (82) mate with connectors in the end cap (84). The end cap (84) contains a user-operable control (90) that may be coupled to a power source and the heating element (82). The user-operable control (90) may be comprised of any of the configurations previously discussed, such as a button, flexible metal disc, toggle, switch, dial, digital selector, potentiometer, or any other combination of these or other means by which a user may directly or indirectly regulate administration of power from the power source to the heating element (82). In the illustrated embodiment, the control (90) is a user operable switch having indicia marked thereon.

In this embodiment, the heating element heat wrap (82) is applied at least to hand-holding locations on the exterior of the lacrosse stick shaft (86). When the user-operable control (90) is activated, power is provided to the heating element (82), which then generates resistive heat along the length of the tape or wrap to warm the hand-holding locations.

Figure 6B:
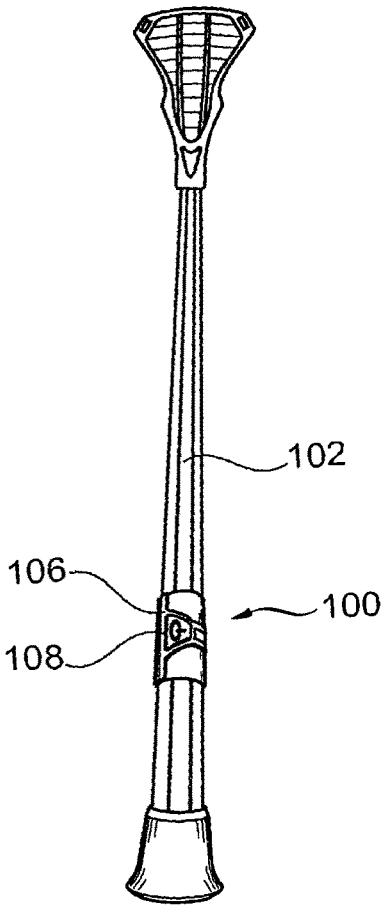
Figure 6A:
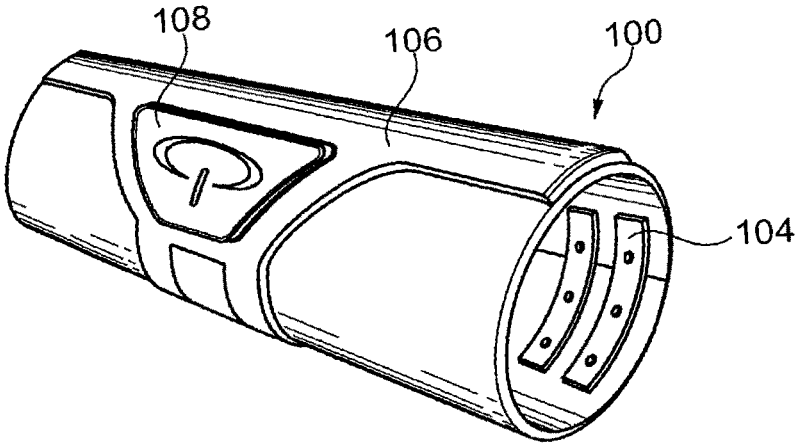

FIGS. 6*a* and 6*b* illustrate views of a lacrosse stick heating apparatus (100) in accordance with another embodiment, and the lacrosse stick heating apparatus (100) applied to a lacrosse stick shaft (102).

In this embodiment, the heating apparatus (100) is shaped to be applied externally to the lacrosse stick shaft (102). The heating apparatus (100) includes a sleeve (106) that is configured generally in the shape of a hollow cylinder of a size to be securely attached on the outside surface of the lacrosse stick shaft (102). The sleeve (106) slides onto or wraps around a lacrosse stick shaft (102). The format, including the shape, weight, size and location, of the heating apparatus (100) again may be configured to conform to lacrosse stick regulations promulgated by lacrosse governing bodies, including but not limited to US Lacrosse, the Federation of International Lacrosse (FIL), the National Collegiate Athletic Association (NCAA), or the National Federation of State High School Associations (NFHS). Similarly, the heating apparatus (100) may be user-adjustable to conform to varied lacrosse stick shaft characteristics.

The sleeve (106) includes heating elements (104) may be comprised of metal contacts that conduct electricity to a heating element or that themselves generate resistive heat when electricity is applied from a power source. The power source may be internal to the sleeve (106), and is selectively coupled to the heating elements (104) by a user-operable control (108) that is provided as a button on the sleeve (106). The sleeve (106) is preferably comprised of a thermally insulating material including silicon, neoprene, rubber, or a similarly heat-resistant material.

In this embodiment, the heating element (104) is applied to hand-holding locations on the lacrosse stick shaft. When the user-operable control (108) is activated, power is provided to the heating element (104), which then generates heat within the sleeve (106), warming the lacrosse stick shaft (102) and the sleeve (106). The heating element (104) may also be configured to generate heat at the edges of the heating apparatus (100) or to conduct the generated heat to the edges. The heat may then be conducted by the material of the lacrosse stick shaft (102) along the lacrosse stick shaft (102) directly to the hand-holding locations of the lacrosse stick shaft (102) which may be adjacent to the heating apparatus (100), providing heat to one or multiple hand-holding locations with only a single heating apparatus (100). Alternatively, multiple heating apparatuses (100) may be provided on the lacrosse stick shaft (102) to heat multiple hand-holding locations. The hand-holding locations on the lacrosse stick shaft (102) are warmed without requiring that the user grasp the sleeve (106).

Figure 7:
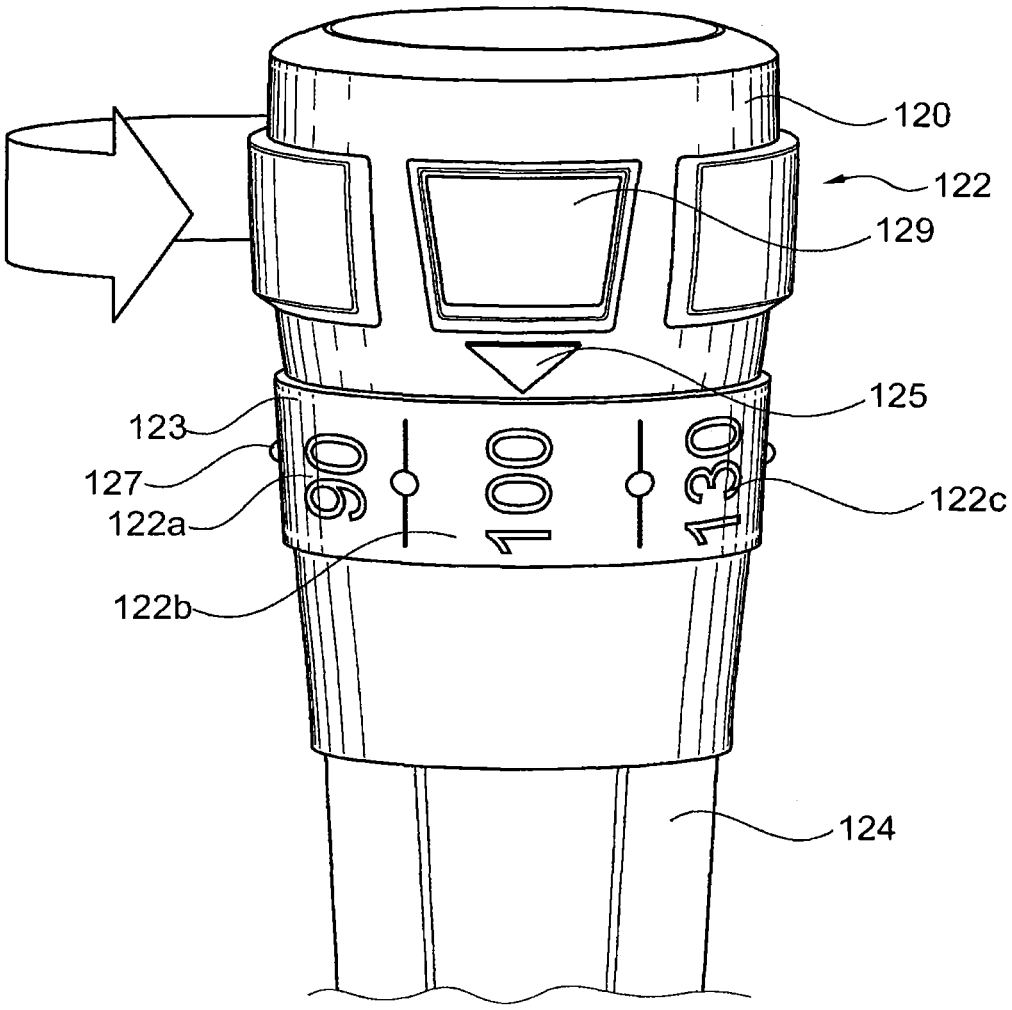
FIG. 7 illustrates a side view of a lacrosse stick end piece with a user-operable control in accordance with some embodiments.

FIG. 7 illustrates a side view of a lacrosse stick shaft end piece (120) with a user-operable control (122) in accordance with another embodiment.

In this embodiment, the end piece (120) fits over the end of the lacrosse stick shaft (124), and integrates a user-operable control (122) that provides a plurality of user-selectable heat settings (122*a*, 122*b*, 122*c*) corresponding to levels of heat emitted by a heating element. The settings on the user-operable control (122) may correspond to general settings, such as "low," "medium," and "high," or to specific temperatures, such as "90°" "100°" or "130°", as shown. Other temperatures are possible. The user may select a desired setting by rotating a ring (123) on the end piece (120) to align a desired setting with an arrow (125). Raised projections (127) on the ring (123) may facilitate rotation of the ring by the user. The rotating ring (123) may be used to select on or off states, or to select levels of heat. The heat level adjustments may be incremental, permitting the user to only select the indicated level, or may be continuous, permitting the user to select heat levels between the indicated levels. An indenture (129) may be configured to permit grip on the end piece (120), to house an indicator as further described within this disclosure, a user-operable control, or for other purposes. The settings may also encompass a number of options, including as few as one heat setting, or as many heat settings as desired, including settings providing a fine degree of control over the level of heat emitted by the heating element. The heat settings may be provided with any indication desired. This disclosure is not meant to be limiting, and the settings may encompass any plurality of settings.

Figure 8:
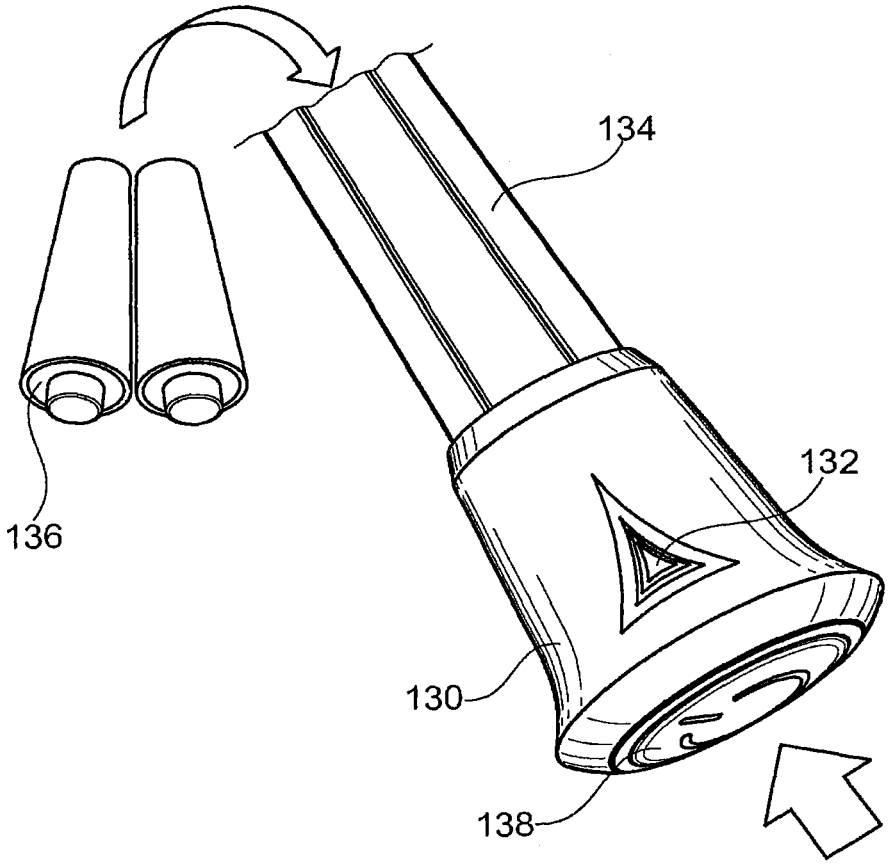
FIG. 8 illustrates a partial, side perspective view of a lacrosse stick end piece with an indicator in accordance with some embodiments and showing schematically the insertion of batteries.

FIG. 8 illustrates a side perspective view of an end piece (130) with an indicator (132) in accordance with another embodiment.

In this embodiment, an indicator (132) is located at the end piece (130) of a lacrosse stick shaft (134), and is electrically connected to the power source (136) and/or user-operable control (138), to provide an indication to the user regarding the status of the heating element and/or the power to the heating apparatus. This may also be provided in conjunction with the user-operable control (138). For example, and without limitation, the indicator (132) may indicate that the device's user-operable control (138) has been activated, that the power source (136) is transmitting power to the heating element, and/or that the heating element has reached the desired temperature. The indicator (132) may also provide, without limitation, the level of power remaining in the power supply, whether the device is recharging, whether the device is fully charged, the level of power being supplied to the heating element, or any other relevant information provided by the power source (136) or user-operable control (138). The indicator (132) may further be configured to provide feedback regarding the approximate level of heat being generated as a result of power being applied to the heating source from the power source (136).

The indicator (132) may be comprised of any suitable means, including for example and without limitation, a monochrome light-emitting diode (LED), a multi-color LED, a liquid crystal display (LCD) display, an organic light-emitting diode (OLEO) display, a miniature incandescent bulb, or another light-emitting source. In operation, the LED or other indicator could provide alternate colors to indicate status, such as green indicating powered-on status, red to indicate low-power status, yellow to indicate recharging status, or any other combination or alternative arrangement. Alternatively, the LED or other indicator could use a single color, and convey similar status states to the user by flashing or remaining fully lit. An LCD or OLEO screen or other indicator may be configured to provide detailed and/or written feedback as to the status state. Any of the methods above may be combined with other options to increase usability, such as the use of icons to show different status states. The location of the indicator (132) is provided on the end piece (130) in this embodiment for example only. The indicator (132) may be located in other locations, such as on the shaft (134) or head of the lacrosse stick.

Conversely, the indicator (132) may be non-visual, and may be a motor internal to the end piece (130) configured to provide haptic feedback regarding the operation of the user-operable control (138) or the power source (136). The indicator (132) may likewise be configured to provide aural feedback, such as via a small speaker to generate one or more sounds to indicate a low-power or a recharge-complete status. These explanations are non-limiting, and the indicator may be any method to convey status states to the user. The power source (136) shown includes a pair of batteries, which may be AA cell batteries or AAA cell batteries, or another battery format. The user-operable control (138) in this embodiment includes a push button or switch in the end of the end piece (130).

Figure 9:
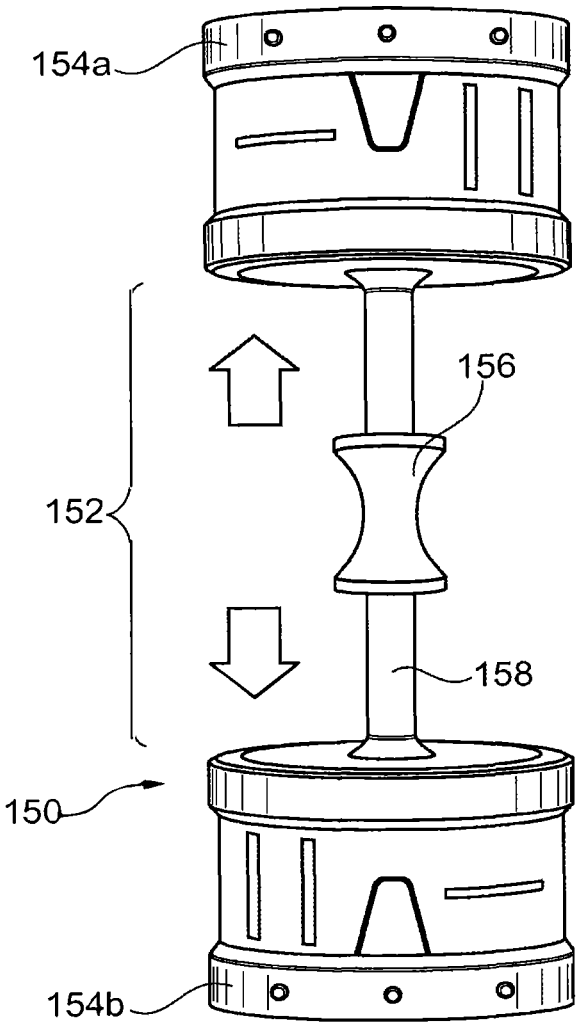
FIG. 9 illustrates a side view of a lacrosse stick kinetic charging heating element in accordance with some embodiments, and including a fragmentary view of the kinetic element.

FIG. 9 illustrates a side view of a kinetic charging heating apparatus (150) in accordance with another embodiment.

In this embodiment, a kinetic charging heating apparatus (150) comprises a kinetic energy charger (152) coupled to a power source, whereby kinetic energy of the lacrosse stick shaft is harvested and provided by the kinetic charger (152) to recharge the power source. The power source may then supply power to heated contacts (154*a*, 154*b*) on its outer surface to transfer generated heat to the hand-holding locations of the lacrosse stick shaft. The configuration of the kinetic heating apparatus (150) provides heat to one or more hand-holding locations on the lacrosse stick shaft.

The kinetic charger (152) may operate using known means of kinetic charging. For example, without limitation, the kinetic charger (152) may operate using a moving magnet that moves relative to a coil to induce an electrical current during motion of the device. This may be referred to as solenoid charging. In certain examples, the kinetic energy harvesting is provided by a sliding magnet, such as rare earth magnet (156), which moves back and forth through the center of or around a solenoid coil (158), which may be a coil of copper wire or other conductor, when the apparatus is moved or shaken. A current is induced in the loops of wire by Faraday's law of induction each time the magnet (156) passes, which charges the power source. In this example, a power source may be a traditional rechargeable power source such as a battery or other rechargeable source or may be a capacitor or other storage device. While a lacrosse player is playing, the incidental movement of the lacrosse stick shaft will cause the magnet (156) to generate power through movement, which is provided to the power source. This disclosure is not meant to be limiting. A kinetic charger may alternative use other known means for charging using kinetic energy, such as a hand crank.

Figure 10:
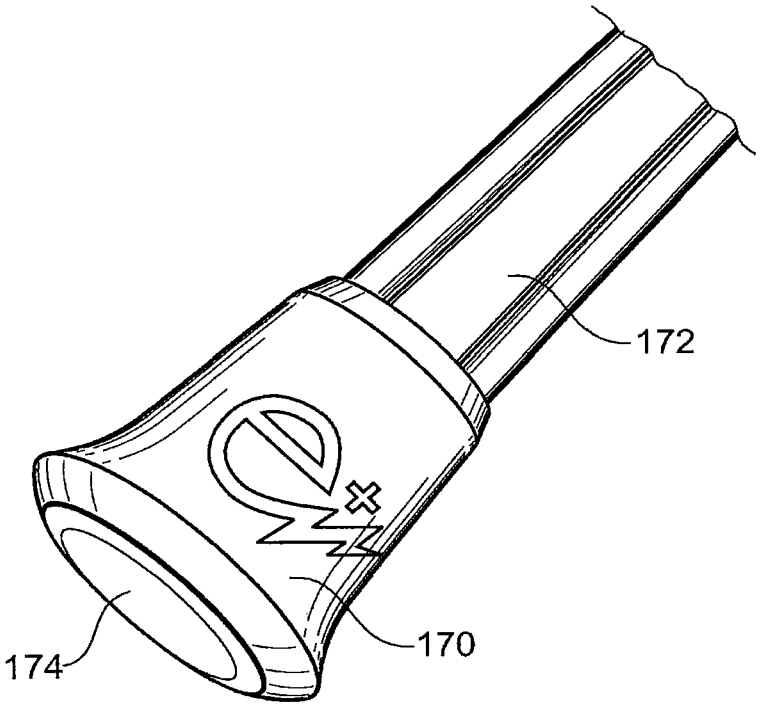
FIG. 10 illustrates a perspective view of a lacrosse stick end piece containing a charging mechanism in accordance with some embodiments.

FIG. 10 illustrates a perspective view of an end piece (170) containing a charging mechanism in accordance with another embodiment.

In this embodiment, the end piece (170) encloses the butt end of the lacrosse stick shaft (172), and is fitted with one or more charging elements (174) at or near the end of the end piece (170). The single charging element (174) of the illustrated embodiment is coupled to a power storage device, such as a rechargeable battery within the end piece (170) or the shaft (172). A second charging element may be provided on the end piece or the shaft or otherwise to provide charging of the rechargeable battery. The charging element (174) may acquire power from an external power source using any known method, including contact charging, or inductive charging. For example, the charging element (174) may be placed into contact with an electrically conductive element of an external power source, such as a charging apparatus, for supplying power to the rechargeable battery. The second conductive contact is also placed into contact with the external power source, providing power to the battery or other power storage device. Alternatively, the charging element (174) may function using inductive power transfer, and be placed in proximity with an electrically conductive element of an external power source, such as a charging apparatus, for supplying power to the rechargeable battery.

The charging element (174) may be a single piece entirely contained in the end piece (170). In embodiments where the charging element (174) recharges the power source using contact charging, in order to provide separate anode and cathode terminals, the contact charging mechanism may utilize multiple charging elements (174), including without limitation another contained elsewhere on the end piece (170), or on the lacrosse stick shaft (172). Alternatively, the charging element (174) may be located at a location other than the end piece (170), such as along the shaft (172) or in the head of the lacrosse stick.

Figure 11:
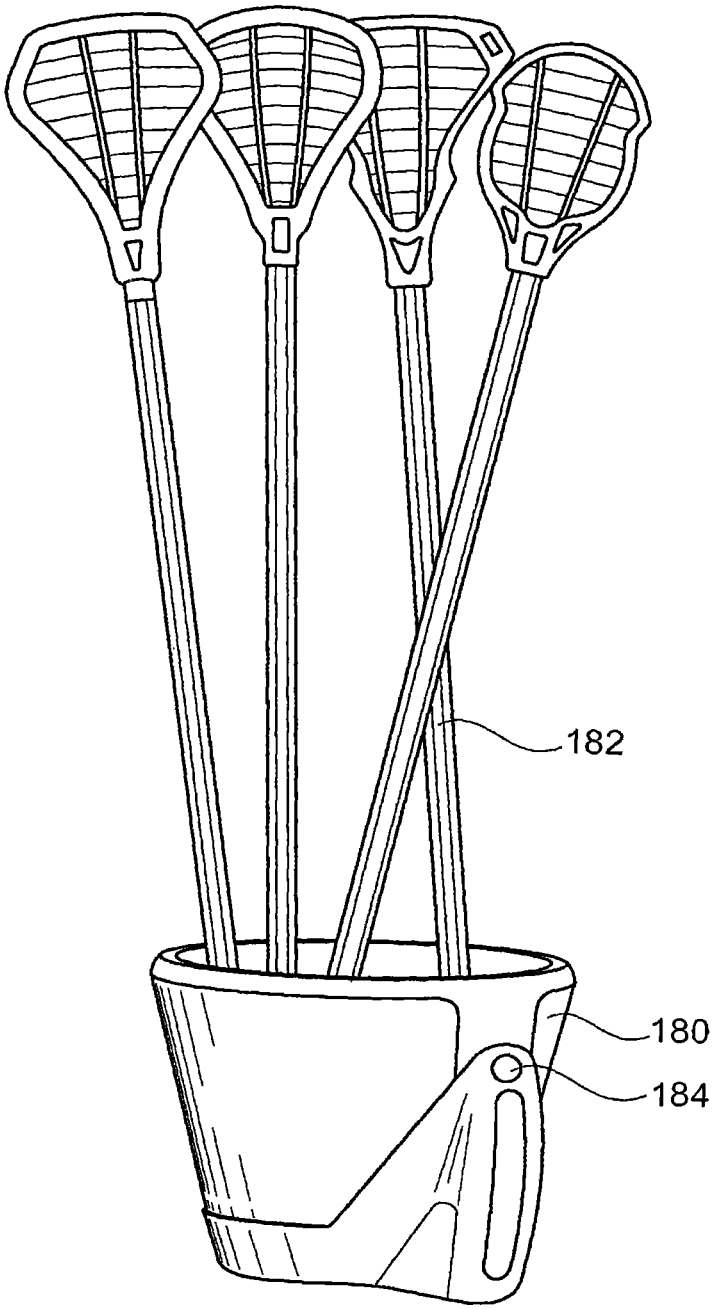
FIG. 11 illustrates a side view of a lacrosse stick charging terminal configured to hold one or more lacrosse sticks while not in use in accordance with some embodiments.

FIG. 11 illustrates a side view of a charging terminal (180) configured to hold one or more lacrosse sticks (182) while not in use in accordance with another embodiment.

In this embodiment, the charging terminal (180) supplies power to the lacrosse sticks (182) while providing a temporary or permanent storage location for the lacrosse sticks (182) while not in use. The charging terminal (180) may be shaped and configured to allow the lacrosse sticks (182) to be easily inserted into the charging terminal (180). In certain embodiments, the charging terminal (180) is, without limitation, in the form of a bucket or trough into which the end piece at the butt end of the lacrosse stick is placed. The bucket may be taller or shorter and may be round in shape or of other shapes.

The charging terminal (180) may be connected to receive power from an external power source or may have its own internal power source contained in the charging terminal. When the charging terminal (180) is activated and one or more lacrosse sticks (182) are place into the charging terminal, the charging terminal provides electrical power to the power storage device of the lacrosse sticks (182). The power transfer between the charging terminal (180) and the lacrosse sticks (182) may be accomplished by any known power transfer method including, without limitation, contact charging and inductive charging. In the illustrated embodiment, the charging terminal (180) provides inductive charging of the power supply within each of the lacrosse sticks (182) positioned in the charging terminal. For example, an inductive power transfer coil is provided in the charging terminal (180) and is supplied with electrical power from either an internal power source or an external power source. Each of the lacrosse sticks (182) is provided with an inductive power transfer coil that is configured to receive inductively transferred power from the charging terminal (180) when placed into the bucket. The power transfer from the bucket-shaped charging terminal (180) to the lacrosse sticks of an entire team, for example, may be accomplished merely by placing the lacrosse sticks (182) in the bucket. The power storage devices for powering the heating systems in the lacrosse sticks (182) are charged while the lacrosse sticks (182) are stored. The charging terminal (180) may be further equipped with an indicator (184) to indicate a charge state for the lacrosse sticks (182) inserted into the charging terminal (180). The charge status shown by the indicator (184) may include, without limitation, fully charged, charging, and almost depleted. The indicator (184) may also provide feedback regarding the status of the external power supply, including whether the external power supply is actively supplying power to the charging terminal (180) or whether the external power supply is ready to supply power to the charging terminal (180). Similarly, the indicator (184) may provide feedback about a portable power source contained in the charging terminal (180), including the amount of power left in the internal portable power source.

FIG. 12*a* illustrates a cut-away side view of a lacrosse stick shaft (190) configured to warm at least portions of the shaft using exothermic oxidation in accordance with another embodiment. FIG. 12*b* illustrates a side view of the lacrosse stick shaft (190) of FIG. 12*a*.

In this embodiment, a lacrosse stick shaft (190) is configured to heat hand-holding locations using exothermic oxidation. In one example, the exothermic oxidation is accomplished using thermal release that is triggered when iron is exposed to air. In this example, air-activated iron (192) is inserted into the inside of a lacrosse stick shaft (190) at one or more locations. The lacrosse stick shaft (190) has perforations (194) that, when opened, will allow air to contact the air-activated iron (192). The air-activated iron (192) may be localized to hand-holding locations through the use of one or more stopper (196) located within the lacrosse stick shaft (190). The stopper (196) may contain a removal tab (198) that may be used to remove the stopper (196) or to adjust the area in which the air-activated iron (192) is contained within the lacrosse stick shaft (190). For a hand-holding location at the butt end of the lacrosse stick shaft (190), an end piece (198) may also be used to contain the air-activated iron (192) within the approximate area of the hand-holding location. Similarly, for a hand-holding location near the head of a lacrosse-stick shaft (190), another stopper (198) and a head piece (202) may be used to position the air-activated iron (192) proximate to a hand-holding location.

As further example, the air-activated iron (192) may be optimized to release heat using known methods. For example, the air-activated iron (192) may be combined with cellulose, iron, water, activated carbon (to evenly distribute heat), vermiculite (to provide a water reservoir) and salt (catalyst). The air-activated iron (192) may also be contained in a warming packet which is configured to be insertable into the lacrosse stick shaft (190). This disclosure is not meant to be limiting, and other methods of producing exothermic heating are contemplated.

FIG. 13 illustrates a side view of a lacrosse stick end piece (210) with a user-operable control (212) configured to activate warming of a lacrosse stick shaft (214) in accordance with another embodiment.

In this embodiment, an end piece (210) is affixed to a lacrosse stick shaft (214), the end piece (210) containing a user-operable control (212) configured to activate heat to hand-holding locations. In some embodiments, the heating may be accomplished via a phase change reaction. In such embodiment, the user-operable control (212) is mechanically coupled or otherwise configured to selectively flex a flexible metal disc located in the lacrosse stick shaft (214). Flexing the metal disc initiates, a phase change in an exothermic phase change material. The phase change material, such as a sodium acetate solution, may also be positioned within the lacrosse stick shaft (214) at a location that may extend within the stick shaft to a location proximate to the hand-holding locations on the external surface of the lacrosse stick shaft (214). In the alternate embodiment of FIG. 13, the metal disk may be mounted on or in a side of the lacrosse stick shaft (214) at a location for activating the phase change material within the lacrosse stick shaft (214) near the hand hold locations. Other phase change activation devices are possible.

In an embodiment using phase change to supply heating, a user may activate the user-operable control (212) in order to begin a phase change reaction in a phase change material. Heat may be produced using phase change, typically crystallization of supersaturated solutions, such as a sodium acetate solution. To activate the phase change operation, a metal disk may be used to induce crystallization, which releases the latent heat associated with the liquid to solid phase change. The phase change material may also be contained in a warming packet which is configured to be insertable into the lacrosse stick shaft (214). This is not meant to be limiting, and other phase change chemicals and configurations are contemplated.

Alternatively, the user-operable control (212) may be used according to other embodiments described herein, to activate heating by controlling a power source or other means of heating the hand-holding areas.

FIG. 14 illustrates a side view of a lacrosse stick end piece (216) and a partial view of a lacrosse stick shaft (220) with a user-operable control (218) configured to regulate warming of the hand-holding areas of a lacrosse stick shaft (220) in accordance with another embodiment. In this embodiment, the user-operable control (218) may be attached to or mounted in the side of the lacrosse stick shaft (220) or mounted within the lacrosse stick shaft (220) and may comprise a button, flexible metal disc, toggle, switch, dial, digital selector, potentiometer, or any other combination of these or other means by which a user may directly or indirectly regulate heating by controlling administration of power from the power source, for example. Similarly, the hand-holding locations may be heated using a heat generating material, such as a phase change material, wherein the phase change material is mounted near to or within the hand-holding locations.

The heated lacrosse stick shaft disclosed herein allows lacrosse players to more comfortably and dexterously operate their lacrosse sticks in cold weather. Not only will this eliminate or greatly reduce discomfort, but allows the use of a lacrosse stick in cold weather without the use of thick or thin gloves. The apparatuses and methods disclosed herein could be constructed as a complete unit or as separate components. For example, the heating elements, power supply and user-operable control may be provided in a single piece that is insertable into the interior of an existing lacrosse stick shaft. The single piece may include the end piece for mounting on the butt end of the stick. Alternatively, the elements of the present device may be provided in one or more separate components that are mounted separately or together in the lacrosse stick shaft. The individual components or a complete system could either be built by the lacrosse stick manufacturer into the shaft at the lacrosse stick before shipping to retail stores or could be sold as a separate "after-market" kit for adding to a lacrosse stick by the lacrosse stick manufacturer, retail seller or by a user.

Thus, specific compositions and methods of a heated lacrosse stick shaft have been disclosed. It should be apparent, however, to those skilled in the art that many more modifications besides those already described are possible without departing from the inventive concepts herein. The method of manufacture and design is not intended to be limited and the full scope of the claims below is contemplated. The inventive subject matter, therefore, is not to be restricted. Obviously, modifications and alterations will occur to others upon reading and understanding the preceding detailed description. It is intended that the invention be construed as including all such modifications and alterations insofar as they come within the scope of the appended claims or the equivalents thereof.

Certain features that are described in this specification in the context of separate embodiments can also be implemented in combination in a single embodiment. Conversely, various features that are described in the context of a single embodiment can also be implemented in multiple embodiments separately or in any suitable sub-combination. Moreover, although features can be described above as acting in certain combinations and even initially claimed as such, one or more features from a claimed combination can in some cases be excised from the combination, and the claimed combination can be directed to a sub-combination or variation of a sub-combination.

Similarly, while operations are depicted in the drawings in a particular order, this should not be understood as requiring that such operations be performed in the particular order shown or in sequential order, or that all illustrated operations be performed, to achieve desirable results. In certain circumstances, multitasking and parallel processing can be advantageous. Moreover, the separation of various system components in the embodiments described above should not be understood as requiring such separation in all embodiments, and it should be understood that certain of the described program components and systems can generally be integrated together in a single software product being executed in one or more networks or packaged into multiple software products for execution in the one or more networks.

It is understood by those familiar with the art that the methods described herein may be implemented in hardware, firmware, or software encoded on a non-transitory computer-readable storage medium.

The systems and processes are not limited to the specific embodiments described herein. In addition, components of each system and each process can be practiced independent and separate from other components and processes described herein.

The previous description of the embodiments is provided to enable any person skilled in the art to practice the disclosure. The various modifications to these embodiments will be readily apparent to those skilled in the art, and the generic principles defined herein may be applied to other embodiments without the use of inventive faculty. Thus, the present disclosure is not intended to be limited to the embodiments shown herein, but is to be accorded the widest scope consistent with the principles and novel features disclosed herein.

What we claim is:

1. A heating apparatus for use with an athletic device having a shaft and a plurality of hand-holding locations associated with portions of the shaft comprising:

a removable self-contained module configured to be received within an athletic device shaft and to emit heat to at least two hand-holding locations of the athletic device shaft, wherein the self-contained module comprises:

a plurality of heating elements configured to emit heat to the at least two hand-holding locations;

a power source configured to supply electrical power to the plurality of heating elements;

a user-operable control, wherein the user-operable control is coupled to the power source, and configured to selectively power on and regulate the heat released from the heating elements; and, a kinetic energy charger electrically coupled to the power source configured to harvest kinetic energy using a solenoid to supply electrical power to the power source.

2. The heating apparatus of claim 1, wherein the self-contained module further comprises at least one replaceable battery that may be charged using the kinetic energy charger.

3. The heating apparatus of claim 1, wherein the power source is a rechargeable power source.

4. The heating apparatus of claim 3, wherein the self-contained module further comprises a charging terminal configured to receive a power input configured to recharge the rechargeable power source.

5. The heating apparatus of claim 4, wherein the charging terminal is configured to recharge from an external power source.

6. The heating apparatus of claim 3, further comprising a charging bank configured to receive a plurality of removable self-contained modules for charging respective rechargeable power sources of the removable self-contained modules using an external power source when not in use.

7. The heating apparatus of claim 1, wherein the self-contained module is configured to emit heat to at least two hand-holding locations separated by a portion of the athletic device shaft nor associated with a heating element.

8. A heating sleeve for use with an athletic device shaft, comprising:

a heating apparatus configured to be placed on an outer peripheral portion of an athletic device shaft end, comprising:

a plurality of heating elements configured to emit heat to an outer peripheral portion of the heating sleeve; and a user-operable control, wherein the user-operable control is coupled to the power source, and selectively regulates the heat emitted from the plurality of heating elements a kinetic energy charger configured to be placed inside an athletic device shaft operatively coupled to the heating apparatus, comprising:

a rechargeable power source configured to harvest kinetic energy of the athletic device shaft movement to recharge the rechargeable power source, wherein the kinetic energy charger harvests kinetic energy using solenoid charging.

9. The heating sleeve of claim 8, wherein the heating elements are metal contacts configured to generate resistive heat.

10. The heating sleeve of claim 8, wherein the plurality of heating elements is further configured to emit heat at least two outer peripheral portions of the heating sleeve separated by a non-heated portion.

11. The heating sleeve of claim 8, further comprising an insulating layer disposed over the plurality of heating elements formed from one of a silicon, neoprene, or rubber material.

12. A kinetic heating apparatus for use with an athletic device shaft comprising:

a kinetic energy charger coupled to a rechargeable power source configured to be disposed within an athletic device shaft and configured to harvest kinetic energy of the athletic device shaft movement to recharge the rechargeable power source, wherein the kinetic energy charger harvests kinetic energy using solenoid charging;

at least one heating element operably coupled to the rechargeable power source and configured to emit heat to at least one hand-holding location along the athletic device shaft.

13. The kinetic heating apparatus of claim 12, wherein the rechargeable power source is a battery.

14. The kinetic heating apparatus of claim 12, wherein the rechargeable power source is a capacitor.

15. The heating apparatus of claim 12, wherein the at least one heating element is configured to heat at least one hand-holding location to a temperature of between 55° F. to 130° F.

16. The heating apparatus of claim 12, wherein the kinetic heating apparatus is further configured to be received within an end of an athletic device shaft.

* * * * *